United States Patent [19]

Mallory

[11] Patent Number: 4,862,007

[45] Date of Patent: Aug. 29, 1989

[54] THERMAL PROTECTION SHELL FOR RADIOACTIVE WASTE CONTAINERS

[75] Inventor: Charles W. Mallory, Severna Park, Md.

[73] Assignee: Westinghouse Electric Corp., Pittsburgh, Pa.

[21] Appl. No.: 109,506

[22] Filed: Oct. 19, 1987

[51] Int. Cl.[4] ..... G21F 5/00

[52] U.S. Cl. ..... 250/506.1; 250/507.1; 376/272

[58] Field of Search ..... 250/506.1, 507.1, 505.1; 376/272

[56] References Cited

U.S. PATENT DOCUMENTS

| | | | |
|---|---|---|---|
| 3,414,727 | 12/1968 | Bonilla | 250/506.1 |
| 3,754,140 | 8/1973 | Beierie | 250/507.1 |
| 3,851,179 | 11/1974 | Irvine | 250/506.1 |
| 3,962,587 | 6/1976 | Dufrane et al. | 250/506.1 |
| 4,147,938 | 4/1979 | Heckman et al. | 250/506.1 |
| 4,445,042 | 4/1984 | Baatz et al. | 250/506.1 |
| 4,532,104 | 7/1985 | Wearden et al. | 376/272 |
| 4,800,283 | 1/1989 | Efferding | 376/272 |

FOREIGN PATENT DOCUMENTS

| | | | |
|---|---|---|---|
| 2198682 | 6/1988 | United Kingdom | 250/506.1 |

*Primary Examiner*—Carolyn E. Fields
*Assistant Examiner*—John A. Miller

[57] ABSTRACT

A thermal protection shell for protecting the exterior walls of a radioactive waste container disclosed herein. The shell generally comprises a wall of heat conductive material, such as aluminum or magnesium, which circumscribes and engages the exterior of the waste container walls in intimate, heat-conducting contact under ambient temperature conditions. The thermal coefficient of expansion of the material forming the shell is chosen to be greater than the thermal coefficient of expansion of the material forming the container walls, which are typically steel, so that the heat-conducting contact between the shell and the outer walls is broken when the shell is exposed to a fire. The shell is formed in sections which are rigidly interconnectable by bolt assemblies formed from the same material as the shell itself. The use of such sections allows the shell to be easily mounted over existing radioactive waste containers, and adjusted to fit containers of different diameters.

21 Claims, 7 Drawing Sheets

THERMAL PROTECTION SHELL FOR RADIOACTIVE WASTE CONTAINERS

BACKGROUND OF THE INVENTION

This invention generally relates to casks for holding and transporting radioactive materials, and is specifically concerned with a thermal portection shell for protecting such casks from damage in the event of a fire.

Casks for transporting radioactive materials such as the waste products produced by nuclear power plant facilities are known in the prior art. The special purpose of such casks is to ship radioactive wastes as safely as possible. Such casks may be used, for example, to ship high-level vitrified waste cannisters to a waste isolation site, or spent fuel rods to a reprocessing facility. At the present time, relatively few of such transportation casks have been manufactured and used since most of the spent fuel and other wastes generated by nuclear power plants are being stored at the reactor facilities themselves. However, the availability of such on-site storage space is steadily diminishing as an increasing amount of fuel assemblies and other wastes are loaded into the spent-fuel pools of these facilities. Additionally, the U.S. Department of Energy (D.O.E.) has been recently obligated, by the National Waste Policy Act of 1983, to move the spent fuel assemblies from the on-site storage facilities of all nuclear power plants to a federally operated nuclear waste disposal facility starting in 1998.

While the transportation casks of the prior art are generally capable of safely transporting wastes such as spent fuel to a final destination, the applicant has observed that there is considerable room for improvement, particularly in the area of fire protection. Nuclear Regulatory Commission (NRC) regulations currently require that Type B casks be capable of withstanding exposure to a fire or other source of infrared radiation which generates a temperature of 1475° F. for at least thirty minutes without significant physical damage, and without the development of excessive internal temperatures and pressures. However, this particular requirement is directly at odds with the requirement that the walls of the casks be capable of conducting, at all times, the heat flux generated by the heat of decay of the radioactive materials contained therein. Accordingly, the problem cannot be solved by merely providing some sort of insulatory sheathing around the casks. While such sheathing might effectively block out excessive heat from a fire of 1475° F. or higher, it would also prevent the heat of decay of the radioactive materials within the casks from dissipating into the ambient atmosphere, thereby causing the build-up of potentially excessive temperatures and pressures within the casks itself.

Various attempts have been made to solve the problem by means of an external structure around a cask that acts as a "thermal diode", readily conducting heat from the inside of the cask outwardly, but resisting the conduction of heat from the outside of the cask to its interior. However, all of the prior art attempts to solve the problem require the provision of a relatively delicate and complex structure of thermal cooling fins. Thermal bridges between the cask and the fins are either opened or closed in accordance with the effect of an external source of heat on a material within the fin structure, such as solid lithium and sodium hydroxide, or blocks of aluminum. Unfortunately, such prior art solutions suffer from a variety of shortcomings. For example, the fin structures common to each design are intricate, and require and extensive fabrication effort. Moreover, these fin structures are delicate, and apt to collapse if exposed to a large amount of mechanical shock. Such vulnerability to shock jeopardizes the ability of such prior art thermal shields to operate in a situation where a tractor-trailer transporting the cask is involved in a collision which subjects the cask to a combination of both mechanical shock and fire. Finally, each of these known thermal protection shields are an integral part of the casks which they attempt to protect. Accordingly, none of these shields is easily adaptable for use on a prior art cask which lacks the thermal protection now required by the NRC.

Clearly, what is needed is a thermal protection shield which is simple and rugged in construction, and not apt to lose its shielding properties when exposed to a substantial mechanical shock. Ideally, such a shield should further be easily machinable out of common materials so as to minimize the cost of fabrication. Finally, it would be desirable if the thermal shield could easily be used on casks already in existence.

SUMMARY OF THE INVENTION

Generally, the invention is a thermal protection shell for protecting the exterior walls of a container used for containing heat generating toxic materials, such as radioactive wastes, which fulfills all of the aforementioned criteria. The thermal protection shell comprises a shell of heat conductive material such as aluminum which circumscribes and engages the exterior container walls in intimate, heat-conducting contact under ambient temperature conditions. The thermal coefficient of expansion of the shell is chosen to be substantially larger than the thermal coefficient of expansion of the container walls so that the heat-conducting contact between the shell and the outer wall becomes substantially broken when the shell is exposed to an exterior source of thermal radiation, such as a fire, that raises the temperature of the shell above a selected point. In the preferred embodiment, the value of the thermal coefficient of expansion of the container walls is between about 5 to $7\times10^6$ inches/degrees F. while the value of the thermal coefficient of expansion of the shell is between about 11 to $14\times10^6$ inches/degrees F.

The shell made may be detachably mounted onto existing radioactive waste containers. To this end, the shell may be formed from a plurality of sections that are rigidly interconnected by connecting assemblies. In the preferred embodiment, each of these connecting assemblies includes a nut and bolt means for securing mutually adjacent edges of the interconnectable sections together. A second nut means threadedly engaged to the bolt means may be included for both fixing the distance between mutually adjacent edges of the interconnectable sections by removing all slack between the edges, and insuring that the connecting assembly leaves no residual tensile forces in the resulting shell which could interfere with the formation of an insulating gap between the shell and the container in the event of a fire. To further insure the connecting assembly will not interfere with the formation of the gap, the nut and bolt means are preferably also formed from a material, having a substantially higher thermal coefficient expansion than the material forming the walls of the container. It should be noted that the adjustability provided by such nut and bolt connecting assemblies advantageously allows a particular shell which has been fabricated for a particular model of cask to fit any such cask despite the dimensional differences caused by machine tolerances.

In the preferred embodiment, the shell has sufficient mass and a melting temperature close enough to the temperature causing gap formation so that the ablation of the shell also serves to obstruct the transmission of heat from the source of thermal radiation to the container walls. In the preferred embodiment, the walls of the container are formed from steel, and the shell is approximately one-half of an inch thick, and formed from either an aluminum, aluminum alloy, magnesium, or a magnesium alloy.

BRIEF DESCRIPTION OF THE SEVERAL FIGURES

FIG. 1 is a prespective view of a novel cask assembly that the thermal shell of the invention is preferably used in connection with;

Figure 6A:
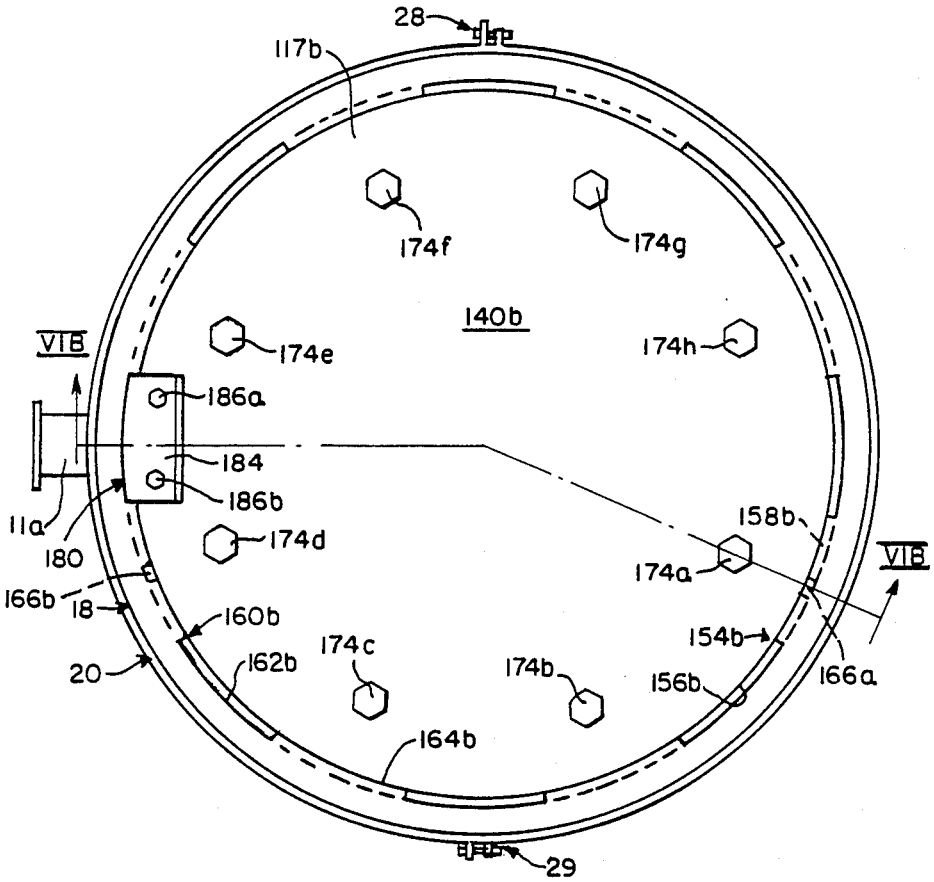
FIG. 6A is a plan view of a breech-lock, double-lidded closure that may be used to close and seal both the shield insert and the outer container.
Figure 6B:
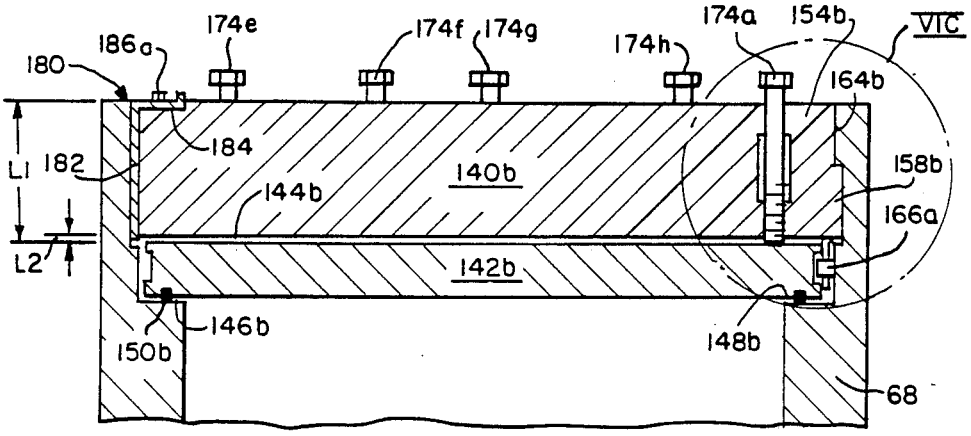
Figure 6C:
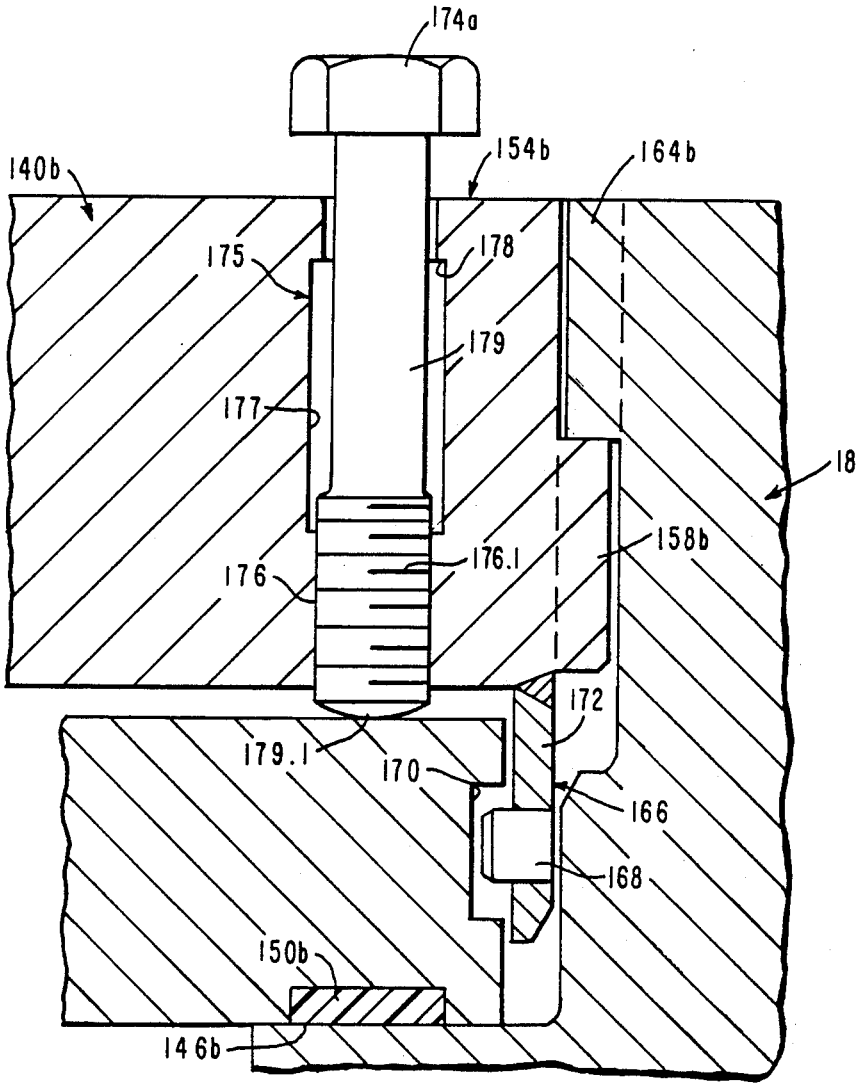

FIG. 6B is a cross sectional view of the closure illustrated in FIG. 6A along the lines 6B—6B, and FIG. 6C is an enlarged view of the area encompassed within the circle in FIG. 6B, illustrating how the flanges and notches which circumscribe the outer edge of the closure and the inner edge of the access opening of the outer container interfit with one another, and further illustrating how the sealing bolts sealingly engage the gasket of the inner lid around this opening.

DETAILED DESCRIPTION OF THE PREFERRED EMBODIMENT

Figure 1:
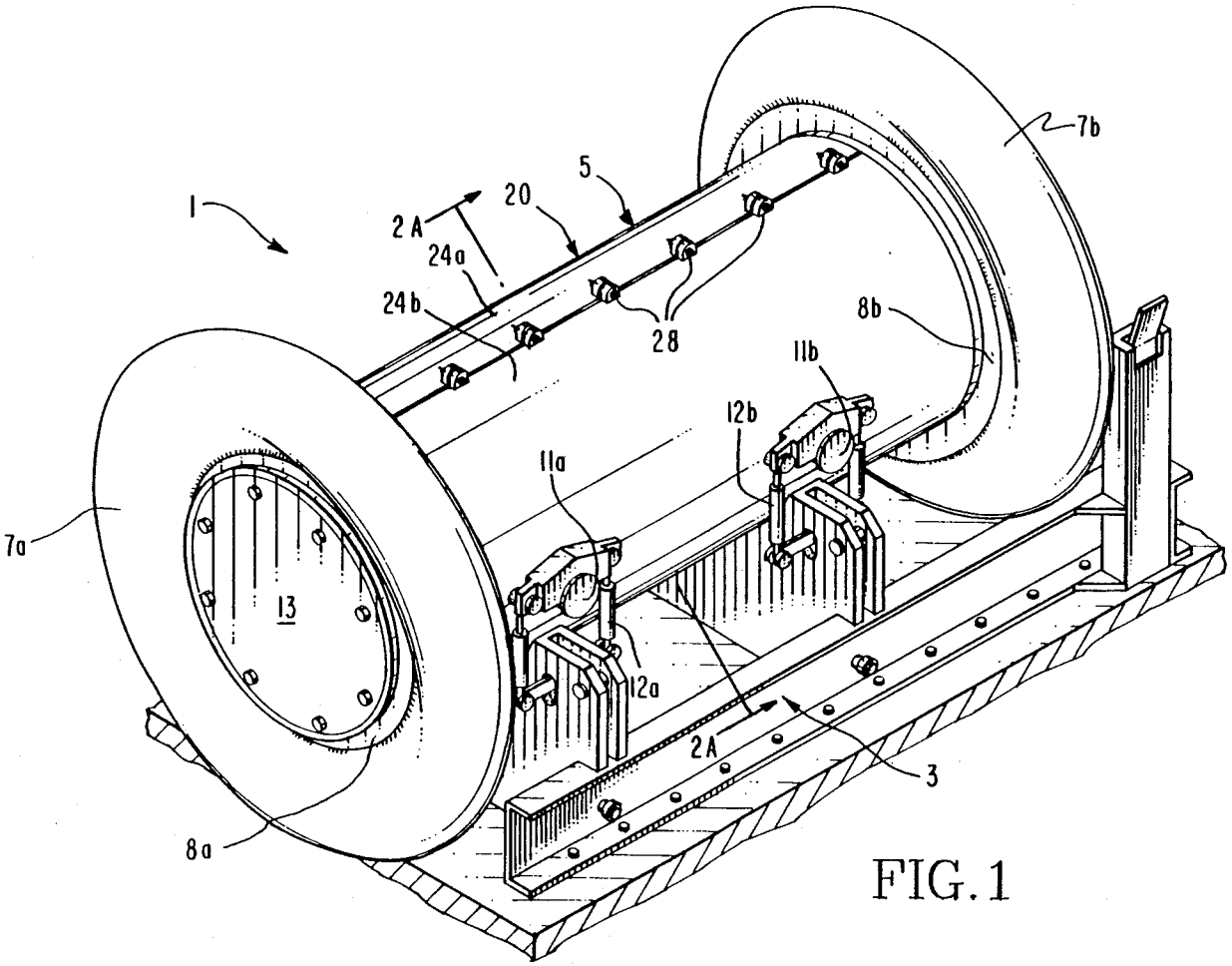

With reference now to FIG. 1, wherein like numerals designate like components throughout all the several figures, the thermal protection shell 20 of the invention is preferably used to protect a cask assembly 1 for carrying radioactive materials of different activities aboard a vehicle such as a tractor-trailer. In use, the thermal protection shell 20 covers the cask assembly 1 which may be mounted within a novel biaxial restraint cradle 3. The cradle 3 may in turn be secured onto the trailer of a tractor-trailer (not shown).

Figure 3:
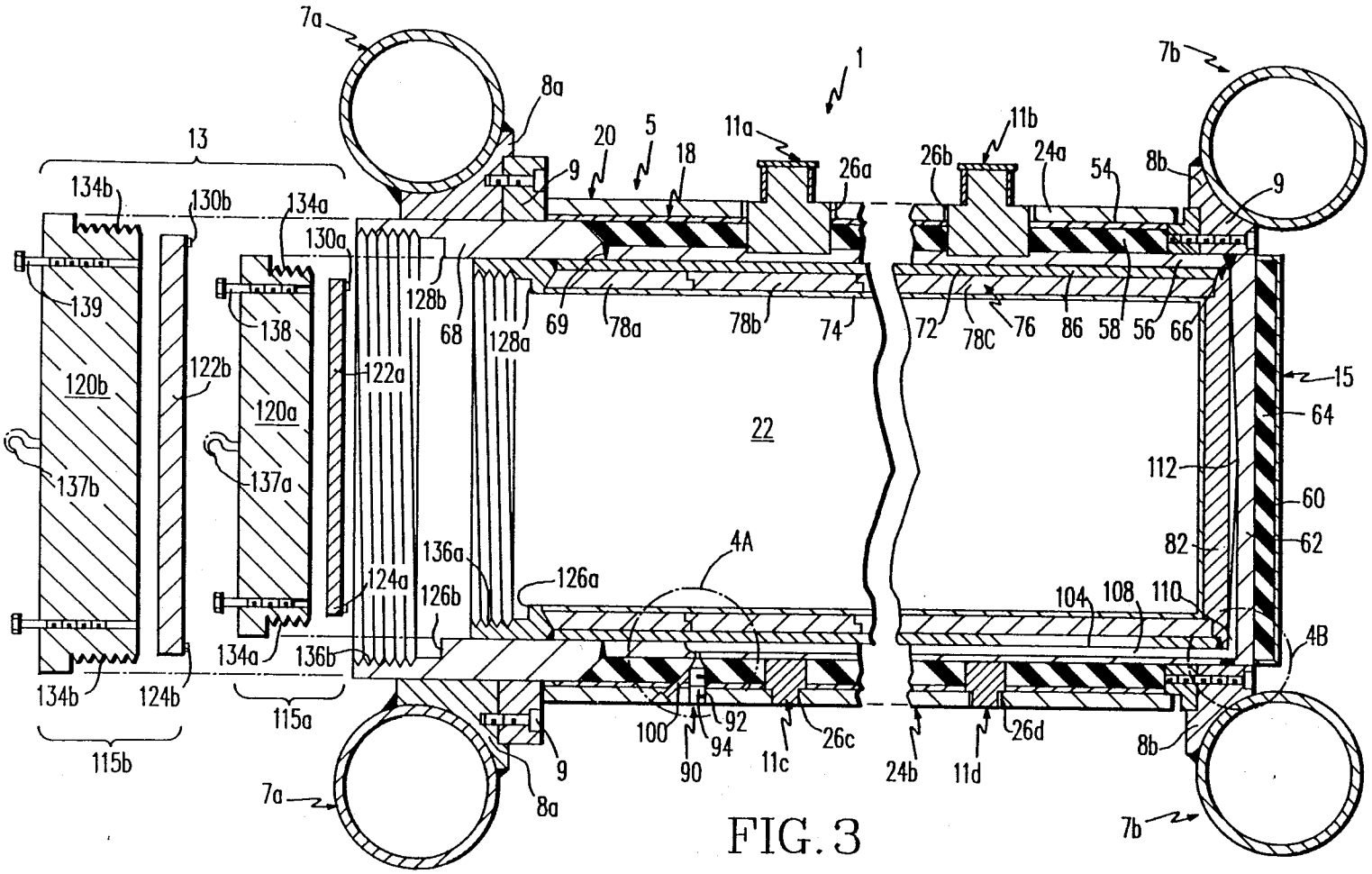
FIG. 3 is a cross sectional side view of the cask assembly, showing how one of the shield inserts slideably fits into the interior of the outer container, and how screw-type, double-lidded closures (shown in exploded form) may be used to close and seal both the shield insert and the outer container.
Figure 5:
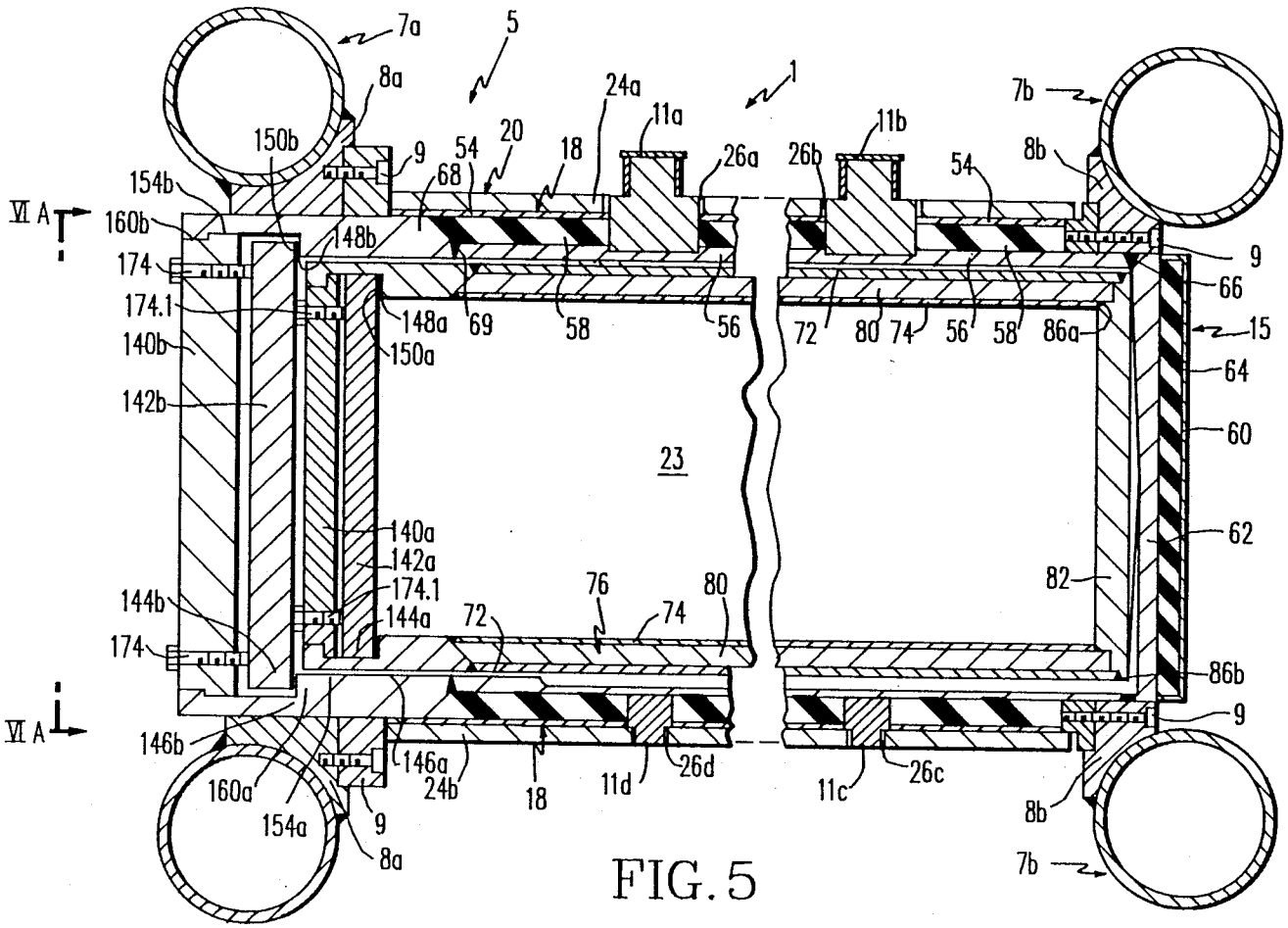
FIG. 5 is a cross sectional side view of the cask assembly used in connection with the invention, showing an alternative shield insert disposed within the interior of the outer container that is particularly well suited for carrying neutron-emitting radioactive materials.

Generally, the cask assembly itself has a cylindrical body 5 which is circumscribed on either end by toroidal impact limiters **7*a*, and 7*b*. Each of these impact limiters 7*a*, 7*b* is a donut-shaped shell of yieldable aluminum which is approximately one-fourth of an inch thick. Each of the toroidal impact limiters 7*a*, 7*b* is mounted around its respective end of the cylindrical body 5 by means of a support ring assembly 8*a*, 8*b* which in turn is secured to the cylindrical body 5 by a plurality of bolts 9. Disposed between the impact limiters 7*a*, 7*b* are a pair of opposing turnnions 11*a*, 11*b* and 11*c*, 11*d*. The two pairs of trunnions are disposed 180 degrees apart around the cylindrical body 5 of the cask assembly 1, and are receivable within two pairs of turn buckle assemblies 12*a*, 12*b*, and 12*c*, 12*d* (of which only 12*a* and 12*b* are visible) that form part of the cradle 3. The cylindrical body 5 is capped by a closure 13 at one end, and an end plate assembly 15 (shown in FIG. 3) at the other end. As is best seen in FIGS. 3 and 5, the cylindrical body 5 of the cask assembly 1 is generally formed by an outer container 18 which is surrounded by the thermal protection shell 20 on its exterior, and which contains in its interior one of two different shield inserts 22 or 23, depending upon the activity and type of radiation emitted by the material to be transported. While only two specific types of shield inserts 22 and 23 are specifically disclosed herein, it should be noted that the inserts 22 and 23** are merely exemplary, and that the cask assembly may in fact be used with any number of different types of shield inserts formed of different shielding materials and of different wall thicknesses for handling radioactive material within a broad range of activity and radiation type.

Figure 2A:
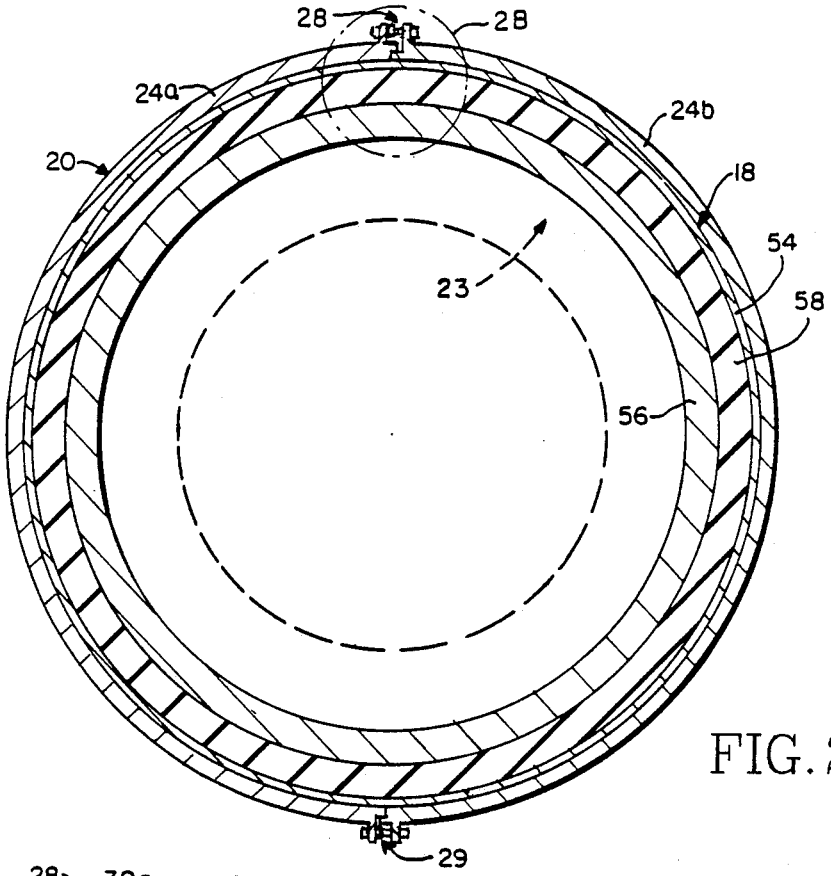
FIG. 2A is a cross sectional view of the cask assembly illustrated in FIG. 1 along the line 2A—2A with the toroidal impact limiters removed, generally showing the structure of the thermal protection shell of the invention.
Figure 2B:
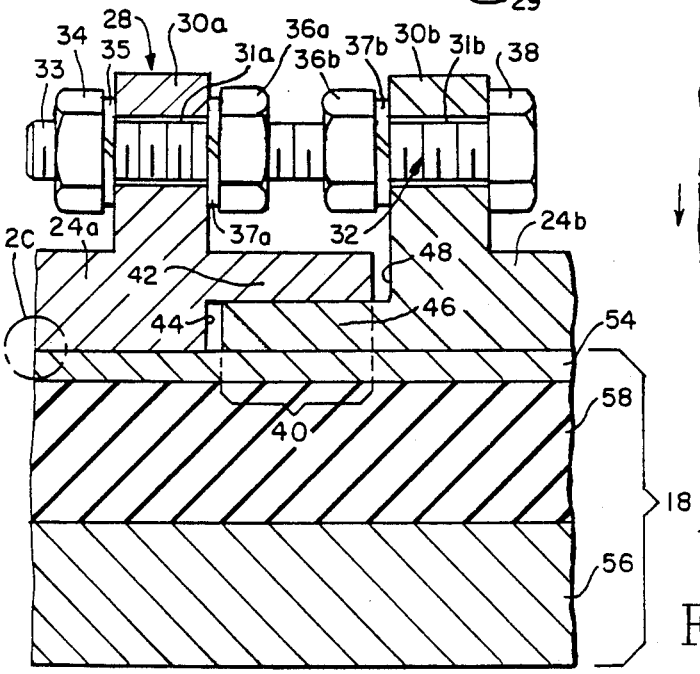
FIG. 2B is an enlarged, cross sectional view of the connecting assembly circled in FIG. 2A which rigidly interconnects the semi-cylindrical sections that form the thermal protection shell of the invention.
Figure 2C:
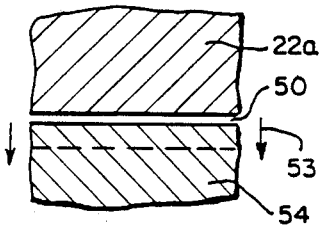
FIG. 2C is an enlargement of the area circled in FIG. 2B, demonstrating how the distance between the outer surface of the outer container and the inner surface of the thermal protection shell increases when the shell is exposed to a source of thermal radiation such as a fire.

When reference now to FIGS. 2A, 2B, and 2C, the thermal protection shell 20 which circumscribes the outer container 18 of the cask assembly 1 is formed from a pair of semi-cylindrical shell sections **24*a*, 24*b* which are rigidly interconnectable into thermal contact with one another. Each of the shell sections 24*a*, 24*b* includes a pair of cut-outs 26 (shown in FIG. 3) for admitting the trunnions 11*a*, 11*b*, 11*c*, and 11*d*. Each of the shell sections 24*a*, 24*b* is formed from a metal having a thermal coefficient of expansion which is greater than that of the metal that forms the walls of the outer container 18, and which is at least as heat-conductive as the metal which forms the walls 54 of the outer container 18. When the outer wall of the outer container 18 is formed from steel, the shell sections 24*a*, 24*b* are preferably formed from aluminum or magnesium or an alloy of either or both of these metals. The coefficient of thermal expansion of these metals is approximately twice that of the thermal coefficient of expansion of steel. Moreover, the high coefficient of thermal conductivity of each such metal insures that the thermal protection shell 20 will not significantly obstruct the conduction of decay heat conducted through the walls of the outer container 18 which is generated by the radioactive material held within the cask assembly 1. When the diameter of the outer container 18 is between forty and sixty inches, a wall thickness of approximately one-half of an inch is preferred for both of the shell sections 24***a*, 24*b*. Such a wall thickness renders the thermal protection shell 20, as a whole, thin enough to be conveniently retrofitted over many existing transportation casks without significantly adding to the weight thereof, yet is thick enough to maintain the structural integrity needed to expand away from the outer walls of the outer container when exposed to a source of intense thermal radiation, such as a fire. Finally, the preferred thickness of one-half of an inch provides enough mass to give the entire thermal protection shell 20 a significant latent heat of fusion, which will provide still more thermal protection through oblation should the cask 1 be exposed to intense heat.

A plurality of top and bottom connecting assemblies 28, 29 are used to rigidly interconnect the two semicylindrical shell sections 24*a*, 24*b*. Since each of the connecting assemblies 28, 29 are identical in structure, a description will be made only of the top connecting assembly 28 circled in FIG. 2A.

This connecting assembly 28 is formed from a pair of opposing semicircular lugs 30*a* and 30*b* which are integrally formed along the edges of the shell sections 24*a* and 24*b* respectively. These lugs 30*a*, 30*b* include mutually alignable bore holes 31*a* and 31*b* for receiving a connecting bolt 32. The threaded end 33 of the bolt 32 is engaged to a tension nut 34 as shown in FIG. 2B. The distance between the two lugs 30*a*, 30*b* (and hence the distance between the edges of the shell sections 24*a*, 24*b*) is largely determined by the extent of which the end 33 of the bolt 32 is threaded through the tension nut 34. A lock washer 35 is disposed between the tension nut 34 and the lug 30*a* to prevent the nut 34 from becoming inadvertently loosened. A pair of lock nuts 36*a*, 36*b* are threadedly engaged near the center portion of the connecting bolt 32 between the two lugs 30*a* and 30*b*. These lock nuts provide two functions. First, when properly adjusted, they prevent the tension nut 34 from applying excess tensile forces between the two shell sections 24*a* and 24*b* which might interfere with their expansion away from the outer container 18 in the event the cask assembly is exposed to a fire or other source of intense heat. Second, the nuts 36*a*, 36*b* eliminate all slack or play between the lugs 30*a*, 30*b*, thus insuring that the connecting assembly 28 rigidly interconnects the two shield sections 30*a*, 30*b*. Again, lock washers 37*a*, 37*b* are disposed between the lock nuts 36*a* and 36*b* and their respective lugs 30*a* and 30*b* to prevent any inadvertent loosening from occurring.

An overlap 40 is provided between the edges of the two shell sections 24*a* and 24*b* to establish ample thermal contact and hence thermal conductivity between these shell sections. The overlap 40 is formed from an over flange 42 and recess 44 provided along the edge of shell section 24*a* which interfits with a complementary outer flange 46 and recess 48 provided along the opposing edge of shield section 24*b*. The actual length of the overlap 40 will vary depending upon the distance between the two lugs 30*a* and 30*b* as adjusted by the bolt 32, tension nut 34, and lock nuts 36*a* and 36*b*.

In operation, the two sections 24*a*, 24*b* of the thermal protection shell 20 are installed over the cask assembly 1 by aligning the various cutouts 26*a*, 26*b*, 26*c*, and 26*d* with the corresponding trunnions of 11*a*, 11*b*, 11*c*, and 11*d* which project from the cylindrical body 5, and placing the sections 24*a*, 24*b* together so that the lugs 30*a* and 30*b* of each of the connecting assemblies 28, 29 are in alignment with one another and the flanges and recesses 42, 44, and 48, 46 of each overlaps 40 are interfitted. Next, the bolt 32, tension nut 35, lock nuts 36*a*, 36*b*, and lock washers 35, 37*a*, and 37*b* are installed in their proper positions with respect to the lugs 30*a*, 30*b* of each of the connecting assemblies 28, 29. The tension nut 34 is then screwed over the threaded end 33 of connecting bolt 32 until the interior surface of each of the shell sections 24*a* and 24*b* is pulled into intimate thermal contact with the outside wall 54 of the outer container 18. In the preferred method of installing the thermal protection shield, the tension nut 34 of each of the connecting assemblies 28, 29 is initially torqued to a selected maximum on the threaded shaft of the bolt 32 until the nut 34 imparts a significant tensile force between the two lugs 30*a* and 30*b*. This tensile force tends to squeeze the two shell sections 24*a* and 24*b* together around the outer wall 54 of the outer container 18 in a clamp-like fashion, which in turn removed any significant gaps between the outer surface of the wall 54 and the inner surface of the shell sections 24*a* and 24*b* by bending these sections into conformity with one another. In the next step, each of the nuts 34 is relaxed enough to prevent these tensile clamping forces from interfering with the expansion of the thermal protection shell 20 in the event of a fire, yet not so much as to cause the surfaces of the shell 20 and the outer container from becoming diengaged with one another. Thereafter, the lock nuts 36*a* and 36*b* are tightened against the faces of their respective lugs 30*a* and 30*b* to remove all slack in each connecting assembly 28, 29. The end result is a rigid interconnection between opposing edges of the shield sections 24*a* and 24*b*, wherein each of the opposing lugs 30*a* and 30*b* is tightly sandwiched between the tension nut 34 and lock nut 36*a*, or the head of the bolt 38 and lock nut 36*b*, respectively.

If the outer container has no trunnions 11*a*, 11*b*, 11*c*, 11*d*, or other structural members which would prevent the surfaces of the shell 20 and outer container 18 from coming into intimate thermal contact, the shell 20 may assume the form of a tubular sleeve which may be, in effect, heat shrunk into contact over the container 18. This alternative method of installation comprises the steps of removing the impact limiters 7*a*, 7*b*, heating the shell to a temperature sufficient to radially expand it, sliding it over the wall 54 of the outer container 18, allowing it to cool and contract into intimate thermal contact with the wall 54, and reinstalling the impact limiters 7*a*, 7*b*.

FIG. 2C illustrates the typical gap condition between the inner surface of the thermal protection shell 20 and the outer surface of the outer container 18. Under ambient conditions, these two opposing surfaces are either in direct contact with one another or separated by only a tiny gap 50 which may be as much as one mil. Such a one mil separation at various points around the cask assembly 1 does not significantly interfere with the conduction of heat between the wall 54 of outer cask 18, and the thermal protection shell 20. However, when the cask assembly 1 is exposed to a source of intense thermal radiation such as a fire, the substantially higher thermal coefficient of expansion of the aluminum or magnesium forming the shell 20 will cause it to expand radially away from the outer surface of the outer container 18, leaving an air gap 53 (shown in phantom) between the two surfaces. Moreover, since the thermal protection shield 20 is formed from a metal having good heat conductive properties, this differential thermal expansion is substantially uniform throughout the entire circumference of the shield 20, which means that the resulting insulatory air gap 53 is likewise substantially uniform. When this gap exceeds approximately two and one-half mils, the primary mode of heat transfer switches from conductive and convective to radioactive. Thus, the three mil gap provides a substantial thermal resistor between the fire and other source of intense infrared radiation in the outer container 18 of the cask 1.

With reference now to FIGS. 3, 4A, 4B, and 5, the side walls of the outer container 18 of the improved cask 1 are a laminate formed from the previously mentioned outer wall 54, an inner wall 56, and a center layer 58 of shielding material. In the preferred embodiment, the outer wall 54 is formed from low alloy steel approximately one-fourth of an inch thick. Such steel is economical, easy to manufacture, and a reasonably good conductor of heat. In the alternative, stainless steel may be used in lieu of low alloy steel. While the use of stainless steel would be more expensive, it provides the additional advantage of corrosion-resistance. The inner wall 56 is preferably also formed from low alloy steel. However, the inner wall 56 is made two inches thick in order to provide ample structural rigidity and strength to the outer container 18. Disposed between the outer wall 54 and the inner wall 56 is a layer of Boro-Silicone. This material advantageously absorbs neutrons from neutron-emitting radioactive materials (such as transuranic elements), and further is a relatively good conductor of heat. It is a rubbery material easily cast, and may be melted and poured between the inner and outer walls 54, 56 of the outer container 18 during its manufacture. Boro-Silicone is available from Reactor Experiments, Inc., and is a registered trademark owned by that corporation.

The bottom of the outer container 18 is formed by an end plate assembly 15 that includes an outer plate 60, an inner plate 62, and a layer of center shielding material 64. In the preferred embodiment, the outer plate 60 is again formed from a low alloy steel approximately one-forth inch thick. The inner plate 62, like the inner wall 56, is again formed from a layer of low alloy steel approximately two inches thick. The center shielding material 64 is again preferably Boro-Silicone for all the reasons mentioned in connection with the center shielding material 58 of the side walls of the container 18. The low alloy steel inner plate 62 is joined around the bottom edge of the inner wall 56*a* 360′ via weld joint 66. The top of the outer container 18 includes a forged ring of low alloy steel 68. This ring 68 is preferably four inches thick throughout its length, and is integrally connected to the inner wall 56 of the container 18 by a 360′ weld joint 69. The upper edge of the ring 68 is either threaded or stepped to accommodate one of the two types of improved closures 115*b* or 117*b*, as will be explained in detail hereinafter.

With specific reference now to FIGS. 3 and 5, the cask assembly 1 is formed from the outer container 18 and shell 20 in combination with one of two different shield inserts 22 (illustrated in FIG. 3) or 23 (illustrated in FIG. 5). Each of the shield inserts 22, 23 is formed from an outer cylindrical wall 72 which is preferably one inch thick and a cylindrical inner wall 74 which is approximately one-fourth of an inch thick. Both walls are formed from A1S1 304 stainless steel. The corrosion resistance of stainless steel prevents the outer dimensions of the outer wall 74 from becoming distorted as a result of rust, which in turn helps advantageously to maintain a relatively tight, slack-free fit between the shield inserts 22, 23 and the interior of the outer container 18.

Each of the shield inserts 22 and 23 includes a layer of shielding material 76 between their respective outer and inner walls 72, 74. However, in shield insert 22, this shielding material is formed from a plurality of ring-like sections 78*a*, 78*b*, and 78*c* of either depleted uranium or tungsten. These materials have excellent gamma shielding properties, and are particularly well adapted to contain and shield radioactive material emitting high intensity gamma radiation. Of course, a single tubular layer of depleted uranium or tungsten could be used in lieu of the three stacked ring-like sections 78*a*, 78*b*, and 78*c*. However, the use of stacked ring-like sections is preferred due to the difficulty of fabricating and machining these metals. To effectively avoid radiation streaming at the junctions between the three sections, overlapping tongue and groove joints 79 (see FIG. 4A) are provided at each junction. By contrast, in shield insert 23, a layer of poured lead 80 is used as the shielding material 76. While lead is not as effective a gamma shield as depleted uranium, it is a better material to use in connection with high-neutron emitting materials, such as the transuranic elements. Such high neutron emitters can induce secondary neutron emission when depleted uranium is used as a shielding material. While such a secondary neutron emission is not a problem with tungsten, this metal is far more difficult and expensive to fabricate than lead, and is only marginally better as a gamma-absorber. Therefore, lead is a preferred shielding material when high-neutron emitting materials are to be transported. It should be noted that the radius of the interior of the shield inserts 22 and 23 will be custom dimensioned with a particular type of waste to be transported so that the inner wall 74 of the insert comes as close as possible into contact with the radioactive material contained therein. The Applicant has noted that fulfillment of the foregoing criteria provides the most effective shielding configuration per weight of shielding material. Additionally, the thickness and type of shielding material 76 will be adjusted in accordance with the activity of the material contained within the shield insert 22, 23 so that the surface radiation of the cask assembly 1 never exceeds 200 mr. The fulfillment of these two criteria maximizes the capacity of the cask assembly 1 to carry radioactive materials while simultaneously minimizing the weight of the cask.

Figure 4B:
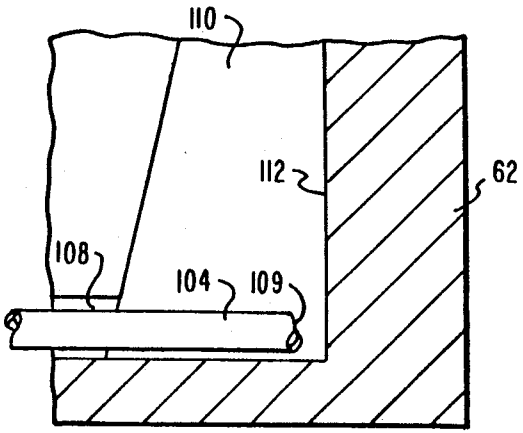
FIG. 4B is a cross sectional side view of the area encompassed within the lower circle in FIG. 3, showing how the bottom end of the drain tube fits into a fluid conducting groove cut into the conical bottom of the outer container of the cask assembly.
Figure 4A:
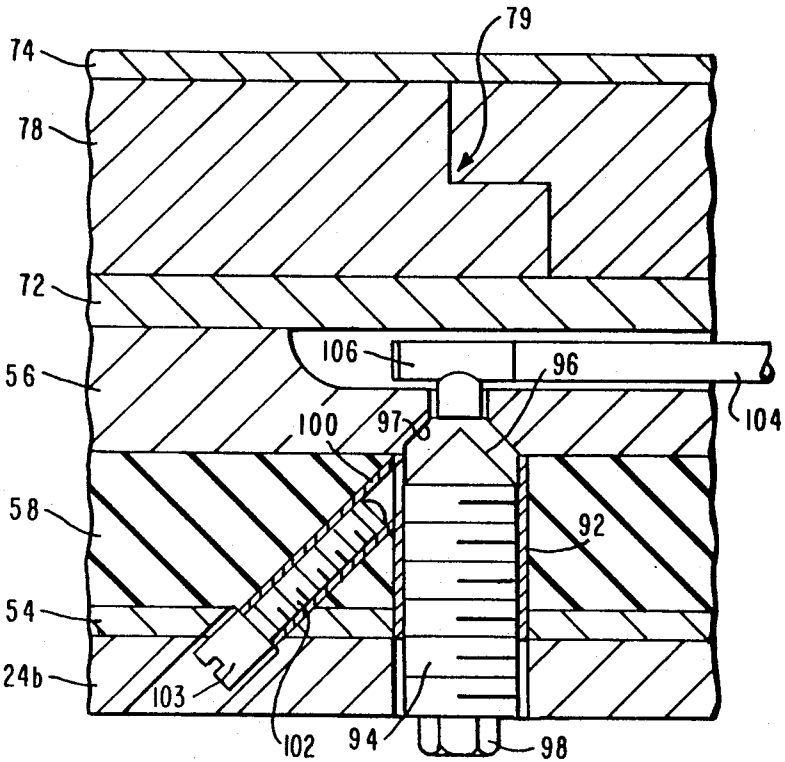
FIG. 4A is an enlarged cross sectional side view of the vent, purge, and drain assembly circled in FIG. 3, showing the drain pipe, the vent pipe, the drain and vent plugs, and the drain tube thereof.

FIGS. 4A and 4B illustrate the vent, purge, and drain assembly 90 of the outer container 18. This assembly 90 includes a threaded drain pipe 92 for receiving a drain plug 94. The inner end 96 of the drain plug 94 is conically shaped and seatable in sealing engagement with a complementary valve seat 97 located at the inner end of the pipe 92. Wrench flats 98 integrally formed at the outer end of the drain plug 94 allow the plug 94 to be easily grasped and rotated into or out of sealing engagement with the valve seat 97. A vent pipe 100 is obliquely disposed in fluid communication with the end of the drain pipe 92. A threaded vent plug 102 is engageable into and out of the vent pipe 100. A screw head 103 is provided at the outer end of the vent plug 102 to facilitate the removal or insertion of the threaded plug 102 into the threaded interior of the vent pipe 100. A drain tube 104 is fluidly connected at its upper end to the bottom of the valve seat 97 by way of a fitting 106. In the preferred embodiment, the drain tube 104 is formed from stainless steel, and is housed in a side groove 108 provided along the inner surface of the wall 56 of the outer container 18. As is most easily seen in FIG. 4B, the lower open end 109 of the drain tube 104 is disposed in a bottom groove 110 which extends through the shallowly conical floor 112 of the outer container 18.

In operation, the vent, purge, and drain assembly may be used to vent the interior of the outer container 18 by removing the vent plug 102 from the vent pipe 100, screwing an appropriate fitting (not shown) into the threaded vent pipe 100 in order to channel gases to a mass spectometer, and simply screwing the conical end 96 of the drain plug 94 out of sealing engagement with the valve seat 97. If drainage is desired, both the drain plug 94 and vent plug 102 are again removed. Gas purging is preferably accomplished after draining by removing the vent plug 102, and connecting a source of inert gas to the drain pipe 92. The partial vacuum within the container 18 that created by the suction pump encourages inert gas to flow down through the drain tube 104. Although not specifically shown, the interior of the drain plug 98 may be provided with one or more rupture discs to provide for emergency pressure relief in the event that the cask assembly 1 is exposed to a source of intense thermal radiation, such as a fire, over a protracted period of time. A suction pump is connected to the drain pipe 92 in order to pull out, via drain tube 104, any liquids which may have collected in the bottom groove 110 of the conical floor 112 of the outer container 18.

The closures 13 used in connection with the cask 1 may be either screw-type double-lidded closures 115*a*, 115*b* (illustrated in FIG. 3), or breech-lock double-lidded closures 117*a*, 117*b* (illustrated in FIG. 5).

With references now to FIG. 3, each of the screw-type closures 115*a*, 115*b* includes an outer lid 120*z*, 120*b*, and an inner lid 112*a*, 112*b*. The inner lid 122*a*, 122*b* in turn includes an outer edge 124*a*, 124*b* which is seatable over a ledge 126*a*, 126*b* provided around the opening 128*a*, 128*b* of the shield insert 22 or the outer container 18 respectively. A gasket 130*a*, 130*b* circumscribes the outer edge 124*a*, 124*b* of each of the inner lids 122*a*, 122*b* of the two closures 115*a*, 115*b*. In the preferred embodiment, these gaskets 130*a*, 130*b* are formed of Viton because of its excellent sealing characteristics and relatively high temperature limit (392 degrees F.) compared to other elastomers. The gasket 130*a*, 130*b* of each of the inner lids 122*a* and 122*b* is preferably received and held within an annular recess (not shown) that circumscribes the outer edge 124*a*, 124*b* of each lid. Each of these gaskets 130*a*, 130*b* is capable of effecting a fluid-tight 360 degree seal between the outer edge 124*a*, 124*b* of each of the inner lids 122*a*, 122*b* and the ledges 126*a*, 126*b*. To facilitate the insertion of shield inset 22 into the container 18, it is important to note that the opening 128*b* of the container 18 is at least as wide as the interior of the container 18 at all points.

Each of the outer lids 120*a*, 120*b* of the screw-type closures 115*a*, 115*b* includes a threaded outer edge 134*a*, 134*b* which is engageable within a threaded inner edge 136*a*, 136*b* that circumscribes the openings 128*a*, 128*b* of the shield insert 22 and the outer container 18 respectively. Swivel hooks 137*a*, 137*b* (indicated in phantom) may be detachably mounted to the centers of the outer lids 120*a*, 120*b* to facilitate the closure operation. Finally, both of the outer lids 120*a*, 120*b* of the screw-type closures 115*a*, 115*b* includes a plurality of sealing bolts 138*a–h*, 139*a–h*, threadedly engaged in bores extending all the way through the outer lids 120*a*, 120*b* for a purpose which will become apparent shortly.

To seal the cask assembly 1, inner lid 122*a* is lowered over ledge 126*a* of the shield insert 22 so that the gasket 130 is disposed between the outer edge 124*a* of the inner lid 122*a* and ledge 126*a*. The detachably mountable swivel hook 137 is mounted onto the center of the outer lid 120*a*. The outer lid 120*a* is then hoisted over the threaded inner edge 136*a* of the shield insert 22. The threaded outer edge 134*a* of the outer lid 120*a* is then screwed into the threaded inner edge 136*a* to the maximum extent possible. The axial length of the screw threads 134*a* and 136*a* are dimensioned so that, after the outer lid 120*a* is screwed into the opening 128*a* to the maximum extent possible, a gap will exist between the inner surface of the outer lid 120*a* and the outer surface of the inner lid 122*a*. Once this has been accomplished, the securing bolts 138*a–h* are each screwed completely through their respective bores in the outer lid 120*a* so that they come into engagement with the inner lid 122*a*, thereby pressing the gasket 130*a* and into sealing engagement between the ledge 126*a* and the outer edge 124*a* of the lid 122*a*. The particulars of this last step will become more apparent with the description of the operation of the breech-lock double-lidded closures 117*a*, 117*b* described hereinafter. To complete the closure of the cask assembly 1, the outer screw-type closure 115*b* is mounted over the opening 128*b* of the outer container 18 in precisely the same fashion as described with respect to the opening 128*a* of the shield insert 22.

With reference now to FIGS. 5, 6A, and 6B, the breech-lock double-lidded closure 117*a*, 117*b* also includes a pair of outer lids 140*a*, 140*b* which overlie a pair of inner lids 142*a*, 142*b* respectively. Each of the inner lids 142*a*, 142*b* likewise includes an outer edge 144*a*, 144*b* which seats over a ledge 146*a*, 146*b* that circumscribes the opening 148*a*, 148*b* of the shielding insert 23 and outer container 18, respectively. Each of the outer edges 144*a*, 144*b* is circumscribed by a gasket 150*a*, 150*b* for effecting a seal between the edges 144*a*, 144*b* and their respective ledges 146*a*, 146*b*. Like opening 128*b*, opening 148*b* is at least as wide as the interior of the outer container 18.

Thus far, the structure of the breech-lock double-lidded closures 117*a*, 117*b* has been essentially identical with the previously described structure of the screw-type double-lidded closures 115*a*, 115*b*. However, in lieu of the previously described screw threads 134*a*, 134*b*, the outer edges 154*a*, 154*b* of each of the outer lids 140*a*, 140*b* are circumscribed by a plurality of uniformly spaced arcuate notches 156*a*, 156*b* which define a plurality of arcuate flanges 158*a*, 158*b*. Similarly, the inner edges 160*a*, 160*b* which circumscribe each of the openings 148*a*, 148*b* of the shield insert 23 and outer container 18, respectively, include notches 162*a*, 162*b* which also define arcuate flanges 164*a*, 164*b*. The flanges 158*a*, 158*b* which circumscribe each of the outer lids 140*a*, 140*b* are dimensioned so that they are insertable through the arcuate notches 162*a*, 162*b* which circumscribe the inner edges 160*a*, 160*b* of the shield insert 23 and the outer container 18. As may best been seen in FIG. 6A and 6C, such dimensioning allows the flanges 164*a*, 164*b* of each of the outer lids 140*a*, 140*b*, to be inserted through the notches 162*a*, 162*b* of each of the openings 148*a*, 148*b* and rotated a few degrees to a securely locked position wherein the arcuate flanges 158*a*, 158*b* of the outer lids 140*a*, 140*b* are overlapped and captured by the arcuate flanges 164*a*, 164*b* that circumscribe the inner edges 160*a*, 160*b*. It should be further noted that the axial length L1 (illustrated in FIG. 6B) of the interlocking flanges 158*a*, 158*b* and 164*a*, 164*b* is sufficiently short to leave a small gap L2 between the inner surface of the outer lids 140*a*, 140*b* and the outer surface of the inner lids 142*a*, 142*b*. The provision of such a small distance L2 between the outer and inner lids allows the outer lids 140*a*, 140*b* to be rotated a few degrees into interlocking relationship with their respective notched inner edges 160*a*, 160*b* without transmitting any rotary motion to the inner lids 142*a*, 142*b* which could cause the inner lid gaskets 150*a*, 150*b* to scrape or wipe across their respective ledges 146*a*, 146*b*.

Connected around the outer edges of the outer lids 140*a*, 140*b* are three suspension pin assemblies 166*a*, 166*b*, and 166*c* and 167*a*, 167*b*, and 167*c* (not shown) respectively. Each of these suspension pin assemblies 166*a*, 166*b*, 166*c* and 167*a*, 167*b*, 167*c* are uniformly spaced 120' apart on the edges of their respective outer lids 140*a*, 140*b*. As the structure of each suspension pin assembly is the same, only a suspension pin assembly 166*a* will be described.

With reference now to FIG. 6C, suspension pin assembly 166*a* includes a suspension pin 168 which is slideably movable along an annular groove 170 provided around the circumference of each of the inner lids 142*a*, 142*b*. A simple straight-leg bracket 172 connects the suspension pin 168 to the bottom edge of its respective outer lid.

In operation, the suspension pin assemblies 166*a*, 166*b*, 166*c* and 167*a*, 167*b*, 167*c*, serve two functions. First, the three suspension pin assemblies attached around the edges of the two outer lids 140*a* and 140*b* mechanically connect and thus unitize the inner and outer lids of each of the breech-lock closures 117*a*, 117*b* so that both the inner and the outer lids of each of the closures 177*a* and 117*b* may be conveniently lifted and lowered over its respective opening 148*a*, 148*b* in a single convenient operation. Secondly, the pin-and-groove interconnection between the inner and the outer lids of each of the two breech-lock type closures 117*a* and 117*b* allows the outer lids 140*a* and 140*b* to be rotated the extent necessary to secure them to the notched outer edges 160*a*, 160*b* of their respective containers without imparting any significant amount of torque to their respective inner lids 142*a*, 142*b*. This advantageous mechanical action in turn prevents the gaskets 150*a* and 150*b* from being wiped or otherwise scraped across their respective ledges 146*a*, 146*b*. In the preferred embodiment, the width of the groove 170 is deliberately made to be substantially larger than the width of the pin 168 so that the pin 168 may avoid any contact with the groove 170 when the outer lids 140*a*, 140*b* are rotated into interlocking relationship with their respective containers 23 and 18.

With reference again to FIG. 6A and 6C, each of the outer lids 140*a*, 140*b* includes eight sealing bolts 174*a–h*, 174.1*a–h* equidistantly disposed around its circumference. Each of these sealing bolts 174*a–h*, 174.1*a–h* is receivable within a bore 175 best seen in FIG. 6C.

Each of these bores 175 includes a bottom-threaded portion 176 which is engageable with the threads 176.1 of its respective bolt 174*a–h*, 174.1*a–h*, as well as a centrally disposed, non-threaded housing portion 177. At its upper portion the bore 175 includes an annular retaining shoulder 178 which closely circumscribes the shank 179 of its respective bolt 174*a–h*, 174.1*a–h*. The retaining shoulder 178 insures that none of the sealing bolts 174*a–h*, 174.1*a–h* will inadvertently fall out of its respective bore 175 in the outer lid 140*a*, 140*b*. In operation, each of the sealing bolts 174*a–h*, 174.1*a–h* is screwed upwardly into its respective bore 175 until its distal end 179.1 is recessed within the threaded portion 176 of the bore 175. After the outer lid 140*a* or 140*b* has been secured into the notched inner edge 160*a* or 160*b* of its respective container 23 or 18, the sealing bolts 174*a–h* 174.1*a–h* are screwed down into the position illustrated in FIG. 6C until their distal ends 179.1 forcefully apply a downward-direction force around the outer edges 144*a*, 144*b* of their respective inner lids 142*a*, 142*b*. Such a force presses the gaskets 150*a* and 150*b* into sealing engagement against their respective ledges 146*a*, 146*b*. It should be noted that the same bolt and bore configuration as heretofore described is utilized in the screw-type double-lidded closures 115*a*, 115*b*.

To insure that the outer lids 140*a* and 140*b* will not become inadvertently rotated out of locking engagement with their respective vessels 23 or 18, a locking bracket 180 is provided in the position illustrated in FIG. 6A and 6B in each of the outer lids 140*a*, 140*b* after they are rotated shut. Each locking bracket 180 includes a lock leg 182 which is slid through mutually registering notches 156*a*, 156*b*, and 162*a*, 162*b* after the outer lids 140*a* and 140*b* have been rotated into locking engagement with the inner edges 160*a*, 160*b* of either the shielding insert 23 or the outer container 18. In the case of outer lid 140*b*, the mounting leg 184 is secured by means of locking nuts 186*a*, 186*b*. In the case of outer lid 140*a*, the mounting leg 184 is captured in place by inner lid 142*b* which abuts against it. Although not specifically shown in any of the drawings, each of the outer lids 120*a*, 120*b* of the screw-type double-lidded closures 115*a*, 115*b* is similarly secured. However, instead of a locking bracket 180, a locking screw (not shown) is screwed down through the outer edges of each of the outer lids 120*a*, 120*b* and into a recess precut in each of the inner lids 122*a*, 122*b*.

I claim:

1. A thermal protection shell for protecting the exterior walls of a container used for containing heat generating toxic materials, characterized by a shell of heat conductive material which circumscribes and engages the exterior container walls in heat-conducting contact under ambient temperature conditions, wherein the thermal coefficient of expansion of the shell is greater than the thermal coefficient of expansion of the outer container walls so that the heat-conducting contact between the shell and the outer walls is substantially broken when the shell is exposed to an exterior source of thermal radiation that raises the temperature of the shell above a selected temperature, and the material forming the shell is fusible near said selected temperature so that the ablation of the shell also serves to obstruct the transmission of heat from the source of thermal radiation to the container walls.

2. A thermal protection shell as defined in claim 1, wherein the thermal coefficient of expansion of the material forming the container walls is about half of the thermal coefficient of expansion of the material forming the shell.

3. A thermal protection shell as defined in claim 1, wherein the value of the thermal coefficient of expansion of the container walls and the shell is between about 5 to $7\times10^6$ inches/degrees F. and 11 to $14\times10^6$ inches/degrees F., respectively.

4. A thermal protection shell as defined in claim 1, wherein the outer walls of the container are formed from an alloy containing iron, and said shell is substantially formed from one metal of the group consisting of aluminum and magnesium.

5. A thermal protection shell as defined in claim 1, wherein the inner surface of the shell expands out of contact with the outer surface of the outer container walls an average of at least two mils when the shell is exposed to exterior thermal radiation above a selected limit.

6. A thermal protection shell as defined in claim 1, wherein said selected temperature is about 800 degrees F.

7. A thermal protection shell as defined in claim 1, wherein said container walls are approximately four inches thick, and said shell is approximately one-half inches thick.

8. A thermal protection shell as defined claim 1, wherein said container comprises means for transporting heat generating radioactive waste.

9. A thermal protection shell as defined in claim 1, wherein said shell is formed from a plurality of interconnectable sections.

10. A thermal protection shell for protecting a radioactive waste container of the type which conducts and dissipates heat generated by the decay of radioactive wastes through heat conductive walls, characterized by a shell of heat conductive metal which substantially covers and engages the exterior of the container walls in heat-conducting contact under ambient temperature conditions so as not to obstruct the dissipation of the decay heat, wherein the thermal coefficient of expansion of the metallic shell is greater than the coefficient of expansion of the outer walls waste container so that said heat-conducting contact between said shell and said outer walls is substantially broken when the shell is exposed to an external source of thermal radiation that raises its temperature above a selected temperature, and the material forming the shell is fusible near said selected temperature so that the ablation of the shell also serves to obstruct the transmission of heat from the source of thermal radiation to the container walls.

11. A thermal protection shell for protecting a radioactive waste container as defined in claim 10, wherein the outer container walls are formed from steel, and said shell is formed from an alloy of one of the group consisting of aluminum and magnesium.

12. A thermal protection shell for protecting a radioactive waste container as defined in claim 10, wherein the thermal coefficient of expansion of the material forming the outer container walls is about half of the thermal coefficient of expansion of the material forming the shell.

13. A thermal protection shell for protecting a radioactive waste container as defined in claim 10, wherein the inner surface of the shell expands away from the outer surface of the outer walls of the container an average of at least two mils when the shell is exposed to exterior thermal radiation above a selected limit.

14. A thermal protection shell for protecting a radioactive waste container as defined in claim 10, wherein said shell is formed from a plurality of mutually adjacent sections that are rigidly interconnected along their edges.

15. A thermal protection shell for protecting a radioactive waste container as defined in claim 14, further including connecting assemblies for rigidly interconnecting the edges of mutually adjacent shell sections.

16. A thermal protection shell for protecting a radioactive waste container as defined in claim 16, wherein said connecting assemblies include an adjustment means for adjusting the distance between said edges so that said shell can accommodate containers of different sizes.

17. A thermal protection shell for protecting a radioactive waste container as defined in claim 10, wherein said shield is approximately one-half of an inch thick, and further functions to protect said container from mechanical shock.

18. A thermal protection shell for protecting a radioactive waste container as defined in claim 10, wherein said selected temperature is 1000 degrees F.

19. A thermal protection shell for protecting a container for transporting radioactive waste of the type that conducts and dissipates heat generated by the decay of radioactive wastes through walls formed at least in part by stainless steel, characterized by a shell formed of an alloy from one of the group consisting of magnesium and aluminum which circumscribes and engages the exterior of the container walls in heat-conducting contact under ambient temperature conditions so as not to obstruct the dissipation of the decay heat into the ambient atmosphere, wherein the difference between the thermal coefficient of expansion between the stainless steel container walls and the shell causes the interior surface of the shell to disengage the exterior surface of the container when the shell is exposed to a source of thermal energy which heats it to a temperature of over 800 degrees F. so that a gap is created between the shell and the container that obstructs the transmission of thermal energy from the source to the container, wherein said shell is formed from a plurality of mutually adjacent sections that are rigidly interconnected along their edges, and further including connecting assemblies for rigidly interconnecting the edges of mutually adjacent shell sections, wherein each of said connecting assemblies include an adjustment means for adjusting the distance between said edges so that said shell can accommodate containers of different sizes.

20. A thermal protection shell for protecting a container for transporting radioactive waste as defined in claim 19, wherein each of said connecting assemblies includes a nut and bolt means for securing said mutually adjacent edges together, and a second and third nut threadedly engaged to the bolt means for adjusting and fixing the distance between said mutually adjacent edges.

21. A method for installing a thermal protection shell around a container for transporting radioactive waste of the type that conducts and dissipates heat generated by the wastes through external metallic walls wherein said shell has an interior that is substantially complementary in shape to the exterior of the container and is formed by a plurality of mutually adjacent sections which are rigidly interconnectable along their edges by connecting assemblies that include adjustment means for adjusting the distance between said edge of said sections, comprising the steps of:

a. positioning said shell sections over the exterior walls of the container so that the edges of said sections are mutually adjacent to one another;

b. interconnecting said sections along their mutually adjacent edges with said connecting assemblies, and c. adjusting the adjusting means of said connecting assemblies so that the distance between the mutually adjacent edges of the sections is short enough to draw the complementary interior of the shell formed by the sections into heat conducting contact with the exterior walls of the container, yet not so short as to create tensile forces between the edge which would substantially interfere with the thermal expansion of the shell interior out of heat-conducting contact with the exterior walls of the container upon the heating of the shell to a temperature above 800 degrees F.

* * * * *